United States Patent [19]

Perazzi

[11] Patent Number: 4,805,332

[45] Date of Patent: Feb. 21, 1989

[54] SNAP MECHANISM FOR DOUBLE-BARRELLED SHOT-GUNS WITH ARRANGEMENT FOR SELECTIVE RELEASE OF THE HAMMERS

[75] Inventor: Daniele Perazzi, Botticino Mattina, Italy

[73] Assignee: Manifattura Armi Perazzi S.p.A., Italy

[21] Appl. No.: 138,290

[22] Filed: Dec. 28, 1987

[30] Foreign Application Priority Data

Oct. 20, 1987 [IT] Italy ..... 5238 A/87

[51] Int. Cl.[4] ..... F41C 19/00

[52] U.S. Cl. ..... 42/42.01

[58] Field of Search ..... 42/42.01, 69.01, 42.03

[56] References Cited

U.S. PATENT DOCUMENTS 3,786,588 1/1974 Soana ..... 42/42.01

4,041,556 5/1978 Katsenes ..... 42/42.01

FOREIGN PATENT DOCUMENTS 1548830 12/1968 France ..... 42/42.01

*Primary Examiner*—Charles T. Jordan

*Assistant Examiner*—Michael J. Carone

*Attorney, Agent, or Firm*—McGlew and Tuttle

[57] ABSTRACT

A snap mechanism is disclosed for use in double-barrelled shot-guns having two hammers and a single trigger. The mechanism utilizes a sled-like selector means mounted on and displaceable transversely on an oscillating connector that connects the trigger with a rocker. The selector interacts with the snap rods of the hammers for selectively releasing or detaching first one hammer and then the other, or viceversa, depending on which of the two barrels is to be used in the firing of the cartridge.

3 Claims, 1 Drawing Sheet

SNAP MECHANISM FOR DOUBLE-BARRELLED SHOT-GUNS WITH ARRANGEMENT FOR SELECTIVE RELEASE OF THE HAMMERS

FIELD OF THE INVENTION

The present invention relates to shot-guns and sporting guns in general and, more particularly, to a snap mechanism for double-barrelled guns of this type with an arrangement for the selective release of the hammers.

BACKGROUND OF THE INVENTION

In the field of double-barrelled shot-guns and sporting guns, whether the barrels are superimposed on one another or positioned side by side, there are already known various snap mechanisms with two hammers pivoting on an underguard and coordinated, respectively, with the firing pins corresponding to the two barrels. These known mechanisms have also a pair of snap rods for blocking the hammers in the cocked position, and a trigger that controls separately, by means of an inertial mass or rocker, the displacement firstly of one snap rod and then of the other nap rod, in order to unhook or release the two hammers in succession. In such known mechanisms, the trigger is connected to the inertial mass or rocker by means of an oscillating connector mounted on the tail of the trigger and displaceable height-wise together with such tail.

Similar snap mechanisms, also called monotrigger batteries, may include also selector means that permit the selective detachment or release firstly of the hammer related to one barrel and then of the hammer related to the other barrel, or viceversa, depending on the requirements of the user.

U.S. Pat. No. 4,091,556 discloses a mechanism of the type described hereabove, in which, according to an embodiment thereof, the oscillating connector for the connection of the trigger to the inertial mass or rocker is provided with steps interacting with the rods of the hammers and is displaceable in the transverse direction, so as to release firstly one hammer and then the other in a reversible sequence. In practice, the sequence of release of the hammers may be modified by moving the connector to the right or to the left through a sled-like control selector mounted on the inertial mass or rocker and positionable transversely thereon.

Such a construction is relatively complex. It calls for oscillations by the connector in two orthogonal directions, that is to say, in the longitudinal direction as well as in the transverse direction and implies some work by the inertial mass or rocker in order to mount the sled-like selector.

BRIEF DESCRIPTION OF THE INVENTION

It is, therefore, an object of the present invention to provide a snap mechanism of the monotrigger type defined above, in which the selector is mounted directly on the connector that connects the trigger to the inertial mass or rocker and is displaceable transversely on the connector.

By such arrangement, one achieves the advantage of leaving unchanged the shape, the mounting and the function of the inertial mass or rocker. Another advantage is the simplification of the construction of the overall device and, particularly, of the connector and of the selector. Still another advantage is the possibility of utilizing a connector susceptible of oscillations only in the direction of the axis of the battery together with the inertial mass or rocker.

To this end, the snap mechanism of the present invention conforms to the recitation given in claim 1.

THE DRAWINGS

An illustration of a practical embodiment of the invention will be presented hereinafter with reference to the accompanying representative, but not limitative drawings, in which FIG. 1 is a perspective view of the mechanism of the invention;

DETAILED DESCRIPTION OF THE INVENTION

Figure 1:
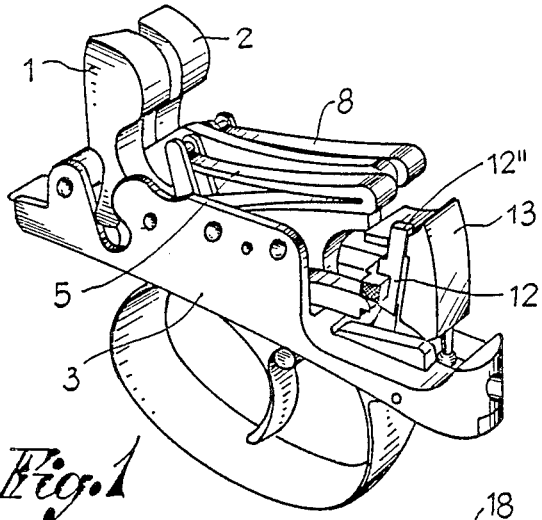

The mechanism of the present invention comprises two hammers 1 and 2, pivoted on the underguard 3 by means of a pivot 4. The hammers have the function of striking the firing pins corresponding to a pair of barrels which may be either superimposed to each other or positioned side by side (not shown)

Hammer 1 is urged, in a manner known per se, by a snap spring 5 and is hooked in the armed or cocked position by a snap rod 6 which is mounted oscillatingly on a pivot 7 and is terminating at its rear end in a beak 6'. Similarly, hammer 2 is urged by a snap spring 8 and is hooked in the armed or cocked position by a snap rod 9 which is mounted, also oscillatingly, on pivot 7 and is terminating at its rear end in a beak 9'.

The displacement of the hammers 1 and 2 into the armed or cocked position is determined by moving levers 10 controlled by the opening of the barrels, while the release or detachment of the hammers for striking is controlled by a single trigger 11, in accordance with a reversible successive action more fully described hereinafter. On the tail of the trigger 11 there is pivoting at 12' an oscillating connector 12, positioned on the rear of the two rods 6 and 9 and displaceable height-wise together with the trigger. Connector 12, furthermore, connects the trigger to an inertial mass or rocker 13, through a small rod 12'' which is integral with the connector 12 and is engaging a corresponding seat 13' provided in the rocker 13. Rocker 13 is pivotably attached underneath, at 14, to the underguard 3 and is urged by a spring that normally keeps it displaced toward the snap rods 6 and 9, together with the connector 12.

The mechanisms, further, comprises a selector arrangement 16 for the selective release or detachment of hammer 1 or hammer 2, for the firing of a cartridge in a first barrel and then in the other, or viceversa.

According to the invention, the selector arrangement 16 consists of a sled-like selector 17 mounted and guided in a corresponding seat 18 transversely provided on the intermediate portion of the oscillating connector 12, the selector 17 being displaceable to two extreme positions defined by a spring-loaded piston 17'.

In its intermediate portion, the selector 17 is provided with a central snap tooth 19 which serves to cooperate, alternately, with beak 6' of rod 6 or with beak 9' of rod 9, depending on the position of the selector itself On opposite sides of the snap tooth 19, the selector has two snap catches 20–21 positioned somewhat backward with respect to the central snap tooth 19 and, therefore, farther spaced or distanced from the beaks 6' and 9' of the rods 6 and 9, respectively.

The catch 20 cooperates with beak 6' of rod 6 when the central snap tooth 19 engages th beak 9' of rod 9. Conversely, the catch 21 cooperates with the beak 9' of rod 9 when the central snap tooth 19 engages the beak 6' of rod 6.

At least beneath the snap tooth 19 there is provided a bevel 22 against which acts the rear terminal of one rod 6 or the other rod 9, so as to move temporarily rearwardly the oscillating connector 12 and, together with it, the rocker, during the phase of arming or cocking the hammers, that is to say, when the rods 6 and 9 move into position of interaction with the selector 17.

Figure 2:
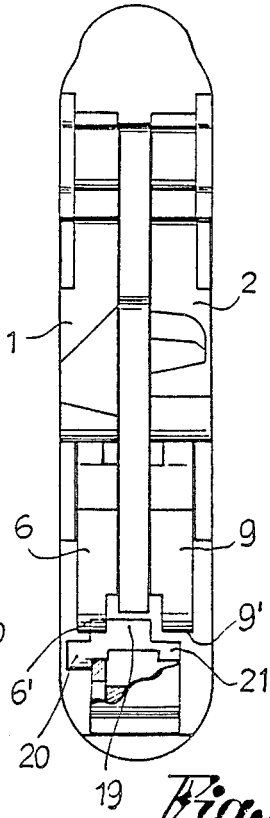
FIG. 2 is a plan view of the mechanism of the invention, after removal of the springs of the hammers and with the selector means in a first position of use.
Figure 5:
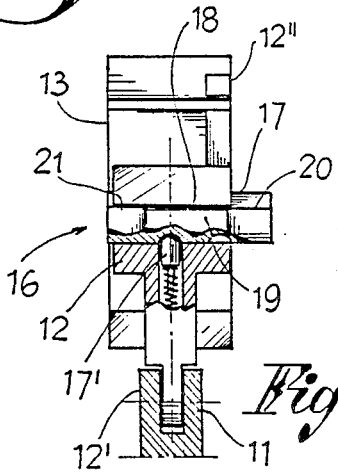
FIG. 5 is a sectional view of a detail of the selector means, taken along arrows V—V of FIG. 4.

In practice, when the sled-like selector 17 is fully displaced to the left, as shown in FIG. 2, its central snap tooth 19 is positioned beneath the rear beak 6' of rod 6 of hammer 1 and cooperates with this beak without interfering with the beak of the rod 9 of the other hammer 2. In this condition, when the hammer are armed or cocked, by acting a first time on the trigger 11, the oscillating connector 12 is displaced upwardly and to this displacement corresponds the movement of the rod 6 by the action thereon of the snap tooth 19, so as to release or detach the hammer 1 and obtain the firing of the cartridge existing in the barrel corresponding to this hammer.

When the trigger is released, the oscillating connector 12 moves downwardly and, urged by the spring-loaded rocker 13 moves forwardly toward the rods until it positions the catch 21 of the selector underneath the beak 9' of the other rod 9.

In this manner, by pressing once again the trigger 11, one causes by means of the catch 21 the displacement of the rod 9 for the release or detachment of the other hammer 2.

Figure 3:
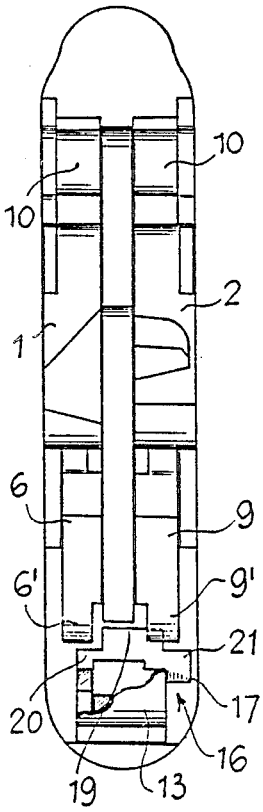
FIG. 3 is a view analogous to that of FIG. 2, but with the selector means in a second position of use.
Figure 4:
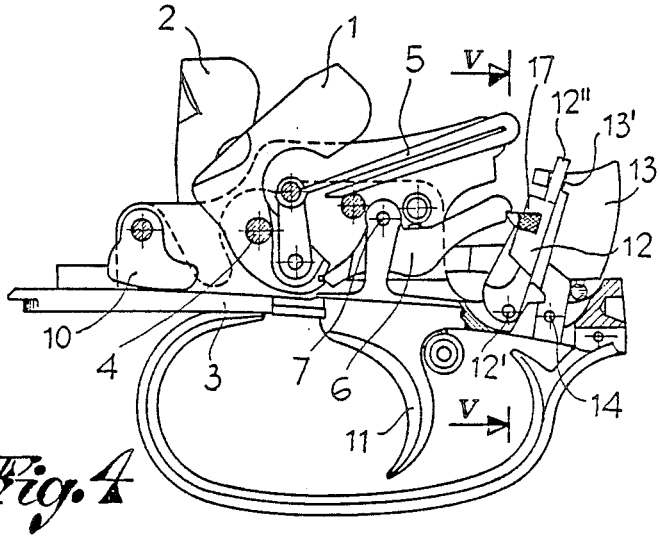
FIG. 4 is a side and partial view of the mechanism of the invention.

When, then, the selector 17 is moved to the right, as shown in FIG. 3, the opposite takes place. The snap tooth 19 is positioned beneath the beak 9' of rod 9 of hammer 2 and it cooperates with this beak, so as to detach firstly the hammer 2 as a result of a first manouver or action of the trigger 11.

Subsequently, after releasing the trigger 11, the catch 20 of the selector 17 engages the beak 6' of rod 6, so that when the trigger is pressed again, the detachment or unhooking of hammer 1 is obtained.

It is, therefore, obvious and evident how the simple positioning of the sled-like selector 17 in one or the other of the two predetermined positions allows the control of the release of the hammers, following two opposite sequences dependent on whether the right barrel cartridge or the left barrel cartridge is to be fired.

What is claimed is:

1. Snap mechanism for double-barrelled shot-guns comprising:

(a) two hammers pivoting on an underguard and coordinated with the barrels' firing mechanisms;

(b) two snap rods for blocking said hammers in the armed position;

(c) a trigger for separately controlling the displacements of said rods, so as to release in succession said two hammers;

(d) an inertial mass or rocker for effecting the actions of said trigger on said rods;

(e) an oscillating connector mounted on said trigger on the tail end thereof and connecting said trigger with said rocker; said snap mechanism being characterized by:

(f) a selector arrangement mounted on said connector and displaceable transversely thereon into two different positions, so as to interact with and detach in succession by means of said rods first one hammer and then the other hammer, following the movements of the trigger.

2. The snap mechanism according to claim 1, wherein said selector arrangement consists of a sled-like selector means mounted on an intermediate portion of said connector, and wherein said sled-like selector means is blocked in each one of said two different positions by a spring-loaded piston.

3. The snap mechanism according to claim 2, wherein said sled-like selector means has a central snap tooth for alternately controlling said rods, said central tooth having on opposite sides thereof two catches positioned rearwardly with respect to the tooth, said catches interacting with said rods and controlling the one of said two rods that is not released by said tooth.

* * * * *